US007198484B2

(12) United States Patent
Hart et al.

(10) Patent No.: US 7,198,484 B2
(45) Date of Patent: Apr. 3, 2007

(54) SYSTEM TO AUTOMATICALLY EXTINGUISH A CANDLE

(75) Inventors: John G. Hart, Galloway, OH (US); Richard N. Rucker, West Jefferson, OH (US)

(73) Assignee: The Candlewatch Co., LLC, Galloway, OH (US)

( * ) Notice: Subject to any disclaimer, the term of this patent is extended or adjusted under 35 U.S.C. 154(b) by 0 days.

(21) Appl. No.: 10/317,202

(22) Filed: Dec. 12, 2002

(65) Prior Publication Data

US 2003/0134242 A1 Jul. 17, 2003

Related U.S. Application Data

(63) Continuation-in-part of application No. 09/758,933, filed on Jan. 11, 2001, now Pat. No. 6,494,708.

(51) Int. Cl.
*F23Q 25/00* (2006.01)
*F21V 25/00* (2006.01)

(52) U.S. Cl. ..... 431/33; 431/146; 431/86; 431/289; 49/29

(58) Field of Classification Search ..... 431/33, 431/34, 35, 86, 144, 146, 149, 152, 289, 431/291, 293; 362/161, 164, 159; 49/29, 49/30, 20

See application file for complete search history.

(56) References Cited

U.S. PATENT DOCUMENTS

| | | | | | |
|---|---|---|---|---|---|
| 147,204 | A | * | 2/1874 | Walton | 362/162 |
| 0,312,291 | A | | 2/1885 | Pinel | 431/35 |
| 0,313,297 | A | | 3/1885 | Bunnell | 431/86 |
| 587,064 | A | * | 7/1897 | Pherson | 431/33 |
| 0,587,064 | A | | 7/1897 | Pherson | 431/33 |
| 736,538 | A | * | 8/1903 | Newsom | 431/33 |
| 0,736,538 | A | | 8/1903 | Newsom | 431/33 |
| 0,886,198 | A | | 4/1908 | Findlay | 431/35 |
| 886,198 | A | * | 4/1908 | Findlay | 431/35 |
| 0,897,712 | A | | 9/1908 | Brusseau | 431/33 |
| 897,712 | A | * | 9/1908 | Brusseau | 431/33 |
| 1,388,504 | A | | 8/1921 | Baker | 431/33 |
| 2,097,182 | A | | 10/1937 | Dodge et al. | 431/78 |
| 2,259,416 | A | * | 10/1941 | Gardner | 362/84 |
| 2,346,455 | A | * | 4/1944 | Russell | 431/152 |
| 2,499,118 | A | * | 2/1950 | Spies | 431/33 |
| 3,885,905 | A | | 5/1975 | Giangiulio | |
| 3,905,746 | A | * | 9/1975 | Patrikios | 431/35 |
| 3,998,922 | A | | 12/1976 | Weiss | 264/255 |

(Continued)

FOREIGN PATENT DOCUMENTS

| | | |
|---|---|---|
| JP | 01110598 | 4/1989 |

(Continued)

*Primary Examiner*—Josiah C. Cocks
(74) *Attorney, Agent, or Firm*—Sterne, Kessler, Goldstein & Fox P.L.L.C.

(57) ABSTRACT

A system and method provide a container holding a candle, a covering portion that can cover an opening of the container holding the candle, a device that automatically extinguishes the candle utilizing the covering portion and an attachment portion shaped to fit around the opening of the container holding the candle. The attachment portion can be removeably secured to the container via a securing system. The attachment portion can also be coupled to the covering portion and the device that automatically extinguishes the candle.

4 Claims, 7 Drawing Sheets

U.S. PATENT DOCUMENTS

| | | | | |
|---|---|---|---|---|
| 4,138,211 | A | 2/1979 | Kampfer et al. | |
| 4,255,117 | A * | 3/1981 | Trotta | 431/34 |
| 5,842,850 | A | 12/1998 | Pappas | 431/291 |
| 5,944,505 | A | 8/1999 | Kroecher | |
| 6,494,708 | B1 | 12/2002 | Hart et al. | 431/33 |
| 6,505,620 | B1 | 1/2003 | Goto | |
| 6,514,070 | B2 | 2/2003 | Lu | |
| 6,572,365 | B1 * | 6/2003 | Byxbe | 431/33 |
| 6,629,836 | B2 | 10/2003 | Campbell | |
| 2001/0029696 | A1 | 10/2001 | DeStefano et al. | |

FOREIGN PATENT DOCUMENTS

| | | |
|---|---|---|
| JP | 3-8208 A * | 1/1991 |
| JP | 09-063352 | 3/1997 |
| WO | WO 87/03070 A1 * | 5/1987 |
| WO | WO 02/23091 | 3/2002 |

* cited by examiner

SYSTEM TO AUTOMATICALLY EXTINGUISH A CANDLE

CROSS REFERENCE TO RELATED APPLICATION

This application is a continuation-in-part of U.S. application Ser. No. 09/758,933, filed Jan. 11, 2001 (now U.S. Pat. No. 6,494,708, which issued Dec. 17, 2002), which is incorporated by reference herein in its entirety.

BACKGROUND OF THE INVENTION

1. Field of the Invention

This invention is directed towards safety devices for candles. More particularly, the invention relates to a method and apparatus for automatically actuating candle snuffers and extinguishers.

2. Background Art

One of the hottest selling products in today's market are candles. These candles come in all shapes, sizes, colors, scents, and containers. Increasingly, candles are being used to set atmosphere, light rooms, change the smell of a room with fragrances, or the like. Unfortunately, one common feature of all candles is that when left unattended for too long a period of time or disturbed they can cause fires. Recently, there has been a real increase in the frequency, severity, and reporting of fires. The worst cases are when these fires are in apartment houses or social houses since there is an even larger potential for damage to property, and even worse, an increased potential for death.

Manufacturers have recognized this problem and are trying to combat the increasing occurrence of fires caused by candles by producing candles in containers, such as jars or the like. Although this solution has been moderately successful in some ways, there are still fires starting because of unattended or forgotten candles being in these containers or when these candles are disturbed in some fashion. One reason for this is users falsely assumed the candles in containers are safer because of their configuration.

Therefore, a need exists for a safety device for candles in containers that automatically extinguishes a candle in a container after a user selected predetermined duration of time has passed. Further, there is a need for a safety device for candles in containers that can automatically extinguish the candle if the container is disturbed.

SUMMARY OF THE INVENTION

Embodiments of the present invention provide an apparatus including a closing portion, a system that can automatically extinguish a candle using the closing portion, and an attachment portion shaped to fit around an opening of a container holding the candle. The attachment portion is removeably secured to the container and coupled to the closing portion and the system that can automatically extinguish a candle.

In one aspect of the present invention, the system that can automatically extinguish a candle includes a timing device having an arm and a resilient device, a support rod, and a support device coupled to the support rod and coupled to the resilient device.

In another aspect of the present invention the system that can automatically extinguish a candle also includes another resilient device coupled to the support rod.

Other embodiments of the present invention provide a method for automatically extinguishing a candle in a container including turning a timing device to an ON state. The method also includes moving a support rod and support device from a first position to a second position when the timing device is in the ON state. The method further includes moving a closing device to an open position when the timing device is in the ON state and resting an extension from the closing device on the support device when the support rod and the support device are in the second position. The method further includes automatically moving the support rod and the support device to the first position when the timer reaches an OFF state, such that the extension is unsupported by the support device, which causes the closing device to return to a closed position.

Still other embodiments of the present invention provide a method for automatically extinguishing a candle in a container including turning a timing device to an ON state. The method also includes moving a support rod and support device from a first position to a second position when the timing device is in the ON state. The method further includes moving a closing device to an open position when the timing device is in the ON state and resting an extension from the closing device on the support device when the support rod and the support device are in the second position. The method further includes automatically moving the support rod and the support device to the first position when a predetermined event occurs to the container, such that the extension is unsupported by the support device, which causes the closing device to return to a closed position.

Still further embodiments provide a system including a container holding a candle, a covering device, a system that automatically extinguishes the candle utilizing the covering device, and an attachment portion shaped to fit around the opening of the container holding the candle. The attachment portion is removeably secured to the container and coupled to the closing device and the system that automatically extinguishes a candle.

Further embodiments, features, and advantages of the present inventions, as well as the structure and operation of the various embodiments of the present invention, are described in detail below with reference to the accompanying drawings.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DESCRIPTION OF THE INVENTION

Figure 1:
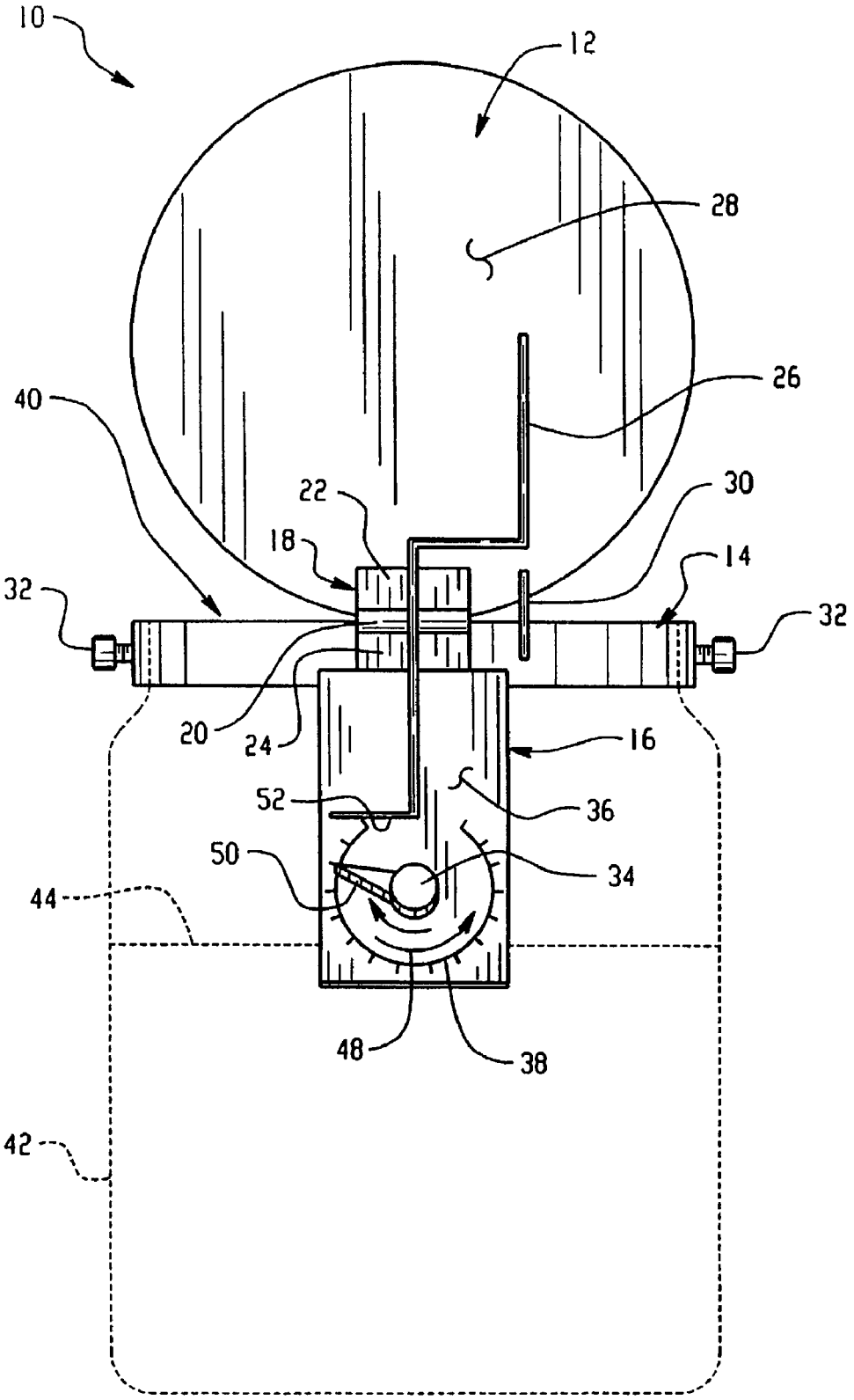
FIG. 1 illustrates a safety device for candles according to a first embodiment of the present invention.

As seen in FIG. 1, an apparatus 10 according to a first embodiment of the present invention is shown. Preferably, the apparatus 10 is a safety device for candles. The apparatus includes a first section 12, a second section 14, and a third section 16. Preferably, the first section 12 is a closing device, e.g., a lid, the second section 14 is an attachment device, e.g., a rim device or ring device, and the third section 16 is a holding device. The apparatus 10 further comprises a coupler 18 that is configured to operatively couple the first through third sections 12–16, respectively, so that the first through third sections 12–16, respectively, move relative to one another. Preferably, the coupler 18 is a hinge or flexible type device. In a preferred configuration, the center portion 20 of the coupler 18 is coupled to the second section 14, a first end portion 22 of the coupler 18 is coupled to the first section 12, and a second end portion 24 of the coupler 18 is coupled to the third section 16.

It is to be appreciated that the first and second sections 12 and 14, respectively, could be made of similar non-flammable material, such as metal, aluminum, alloy, molded plastic, or the like. Also, the third section 16 can be made of any non-flammable material, such as metal, aluminum, alloy, molted plastic, or the like. Further, the coupler 18 can be coupled to the first through third sections 12–16, respectively, with any known material, such as adhesive material or small screws, bolts, or the like.

With continuing reference to FIG. 1, the first section 12 comprises an extension 26 coupled to and extending from a surface 28 and an optional second extension 30 coupled to and extending from the surface 28. The second extension 30 is preferably a stopping device that stops the movement of the closing device 12 as it moves from a first position, e.g., closed, to a second position, e.g., opened a predetermined amount. The second section 14 includes a securing system 32. The securing system 32 is preferably a set of threaded devices that interact with threaded openings (not shown) in the second section 14. It is to be appreciated, alternative embodiments comprise similar functioning securing systems, such as a clasp or spring loaded securing device or a malleable device, e.g., a soft rubber like material, that allows the second section 14 to be secured through form fitting and friction. The third section 16 comprises a timing device 34 coupled to and protruding from a surface 36 and a scale 38 on the surface 36. Preferably, the timing device 34 is a mechanical timer, e.g., a kitchen timer or the like.

Figure 2:
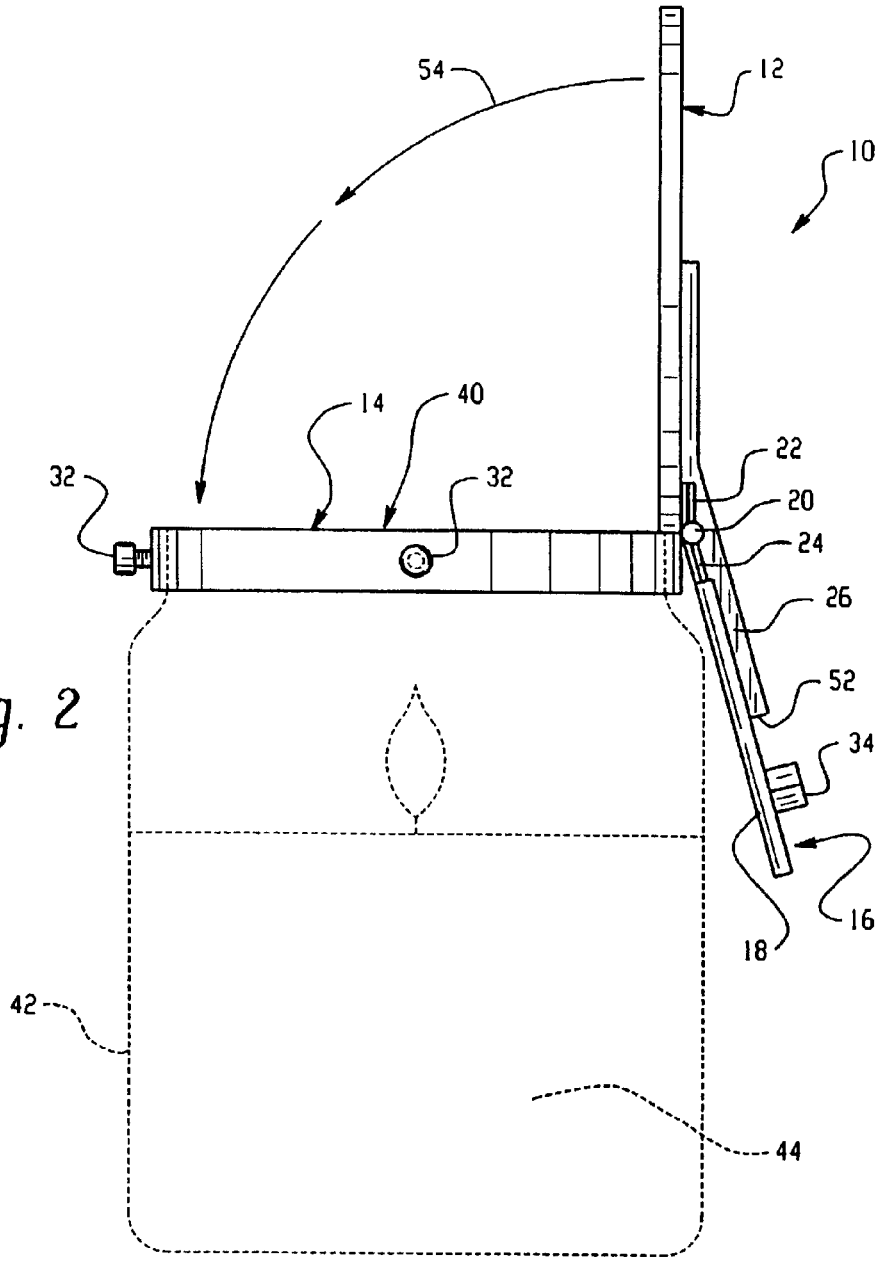
FIG. 2 illustrate a side view of the safety device for candles in FIG. 1.
Figure 3:
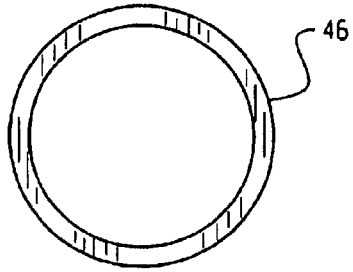
FIG. 3 illustrates a portion of a height adjusting device section of the safety device for candles in FIG. 1.

With further reference to FIG. 1, and reference to FIG. 2, in a preferred embodiment the apparatus 10 is secured adjacent an opening 40 of a container 42. Also, the container 42 comprises a lighted device 44, preferably a candle or the like. The container 42 and candle 44 are represented as dashed lines in FIG. 1. As seen in FIG. 3, a position adjusting device 46, or a plurality of position adjusting devices 46, may be positioned between an inside surface of the second section 14 and the opening 40 of the container 42 to fine adjust a position of the second device 14 until an optimal secured position is found. Preferably, the position adjusting device 46 is utilized when the opening 40 is much smaller than the second section 14. At that time a user can secure the apparatus 10 onto the container 42 with the securing system 32.

A preferred operation of the apparatus 10 with reference to FIGS. 1–2 will now be described after the apparatus 10 has been secured to container 42. A user will lift the first section 12 from the first position, e.g., closed, to the second position, e.g., opened a predetermined amount. In a preferred embodiment the second position cannot be attained unless the timing device 34 has been moved in the direction of arrow 48, e.g., counterclockwise, to an ON position that starts the timing device 34 on a user selected predetermined duration of time. Once the first section 12 is placed in the second position the user can ignite the candle 44. During the duration of time on the timing device 34, determined by the scale 38, air can flow into the container 42 through the opening 40 based on the first section 12 being in the second position. Once the duration of time ends, the timing device 34 will return to an OFF position and a tip portion 50 of the timing device 34 interacts with an end portion 52 of the extension 26 forcing the extension 26 upward. This force causes the first section 12 to move in the direction of arrow 54 returning the first section 12 to the first position. Once the first section 12 is in the first position the lack of air entering the container 42 will extinguish the lighted device 44 in a predetermined amount of time. Preferably, the predetermined amount of time is around 5 seconds. In an alternative embodiment, if during the duration of time a user or someone else disturbs the container or a structure holding the container, e.g., a table or the like, a predetermined amount, the first section 12 will automatically close, which extinguishes the lighted device 44 in the predetermined amount of time.

Therefore, through a preferred arrangement of the apparatus 10 the candle 44 is automatically extinguished after a user selected predetermined duration of time. Thus, a user or a parent, friend, or relative of the user, can gain increased peace of mind when the user wants to light a candle. Further, the arrangement of apparatus 10 will also automatically extinguish the candle 44 when a predetermined amount of disturbance occurs around the candle 44 as an added measure of safety.

Figure 4:
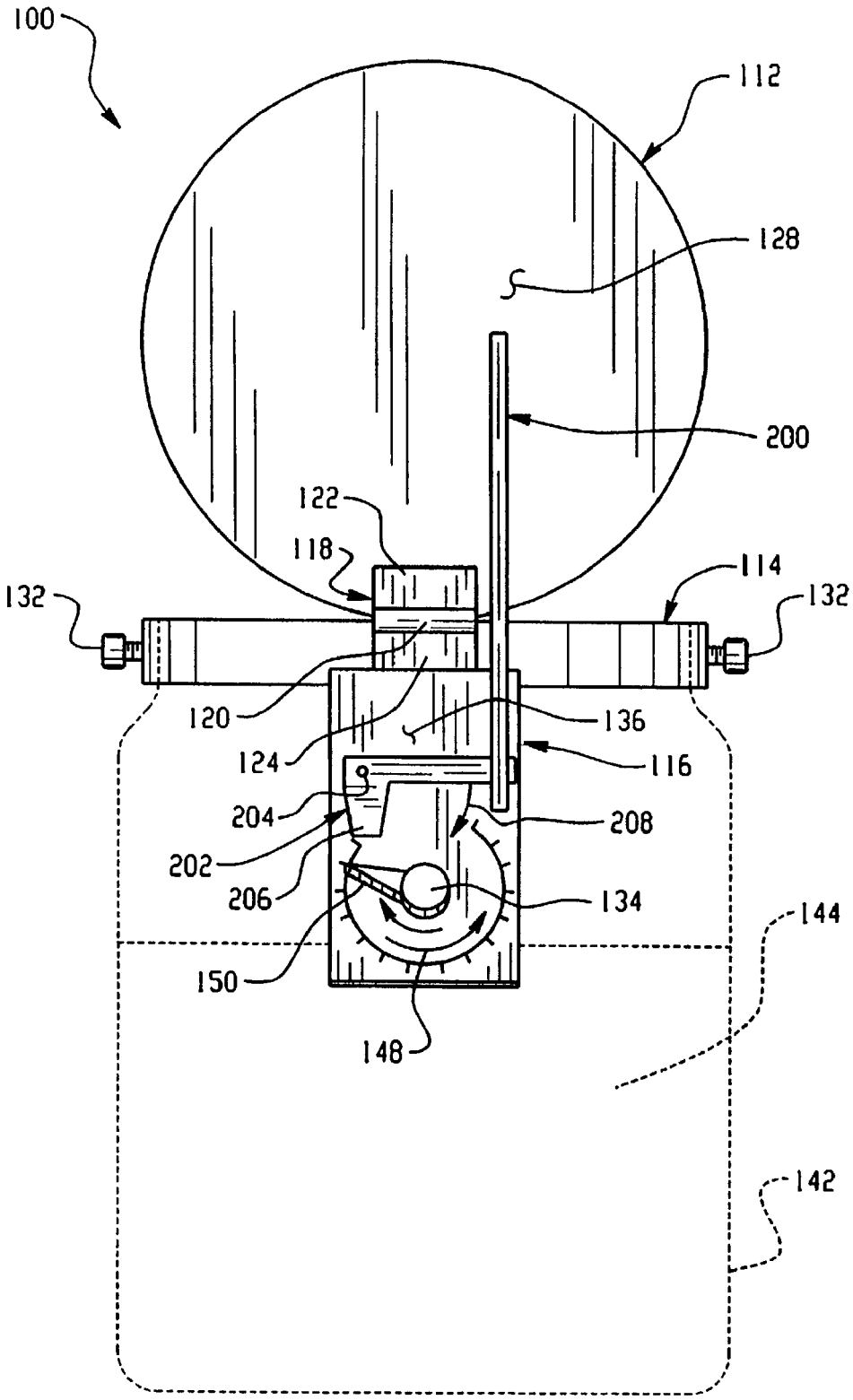
FIG. 4 illustrates a safety device for candles according to a second embodiment of the present invention.

Turing now to FIG. 4, an apparatus 100 according to a second embodiment of the present invention is shown. Throughout the description of FIG. 4, all elements similar to the apparatus 10 in FIGS. 1–2 will have similar elements numbers with a 100 prefix. For example, apparatus 100 in FIG. 4 for apparatus 10 in FIGS. 1–2, first section 112 in FIG. 4 for first section 12 in FIGS. 1–2. These similar elements function similarly to the elements in the previous description, so the description will not be repeated for convenience.

A main difference in the second embodiment shown in FIG. 4 is the shape and interaction of an extension 200 coupled to and extending from a surface 128 of a first section 112 and the addition of a holding device 202 that holds the extension 200 when the first section 112 is in the second position. In this embodiment, the holding device 202 pivots around pivot securing device 204. Thus, in operation an end portion 150 of a timing device 134 will interact with an end portion 206 of the holding device 202 when the duration of time has elapsed and the timing device 134 is in an OFF position. Next, the holding device 202 will pivot in the direction of an arrow 208 to release the extension 200 allowing the first section 112 to return to the first position. Finally, once the first section 112 returns to the first position, the candle 144 is extinguished in a predetermined amount of time since no air can enter the container 142.

It is to be appreciated the container 42 might contain reflective surfaces, or in other alternative embodiments the first section 12 can include reflective surfaces. These reflective surfaces would be utilized to enhance the light produced by the candle 44.

Figure 5A:
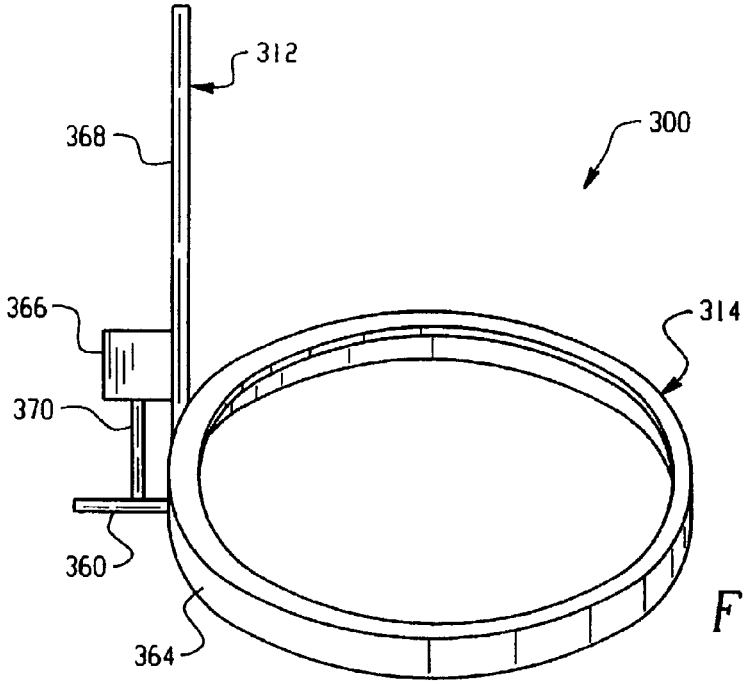
FIGS. 5A and 5B illustrating a safety device for candles according to a third and fourth embodiment, respectively, or the present invention.
Figure 5B:
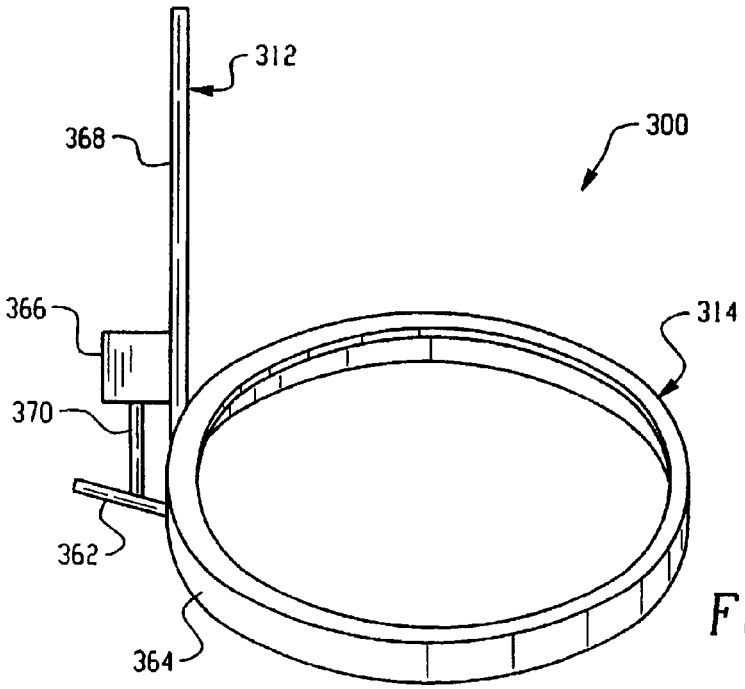

Now with reference to FIGS. 5A and 5B, again similar elements will have similar numbers with a 300 prefix. These FIGS. show an apparatus 300 according to third and fourth embodiments of the present invention. The apparatus 300 comprises a first section 312 and a second section 314. A main difference between the first two embodiments in FIGS. 1–4 and these second two embodiments is that an extension 360 in FIG. 5A and extension 362 in FIG. 5B extends from an outside edge surface 364 of the second section 314. The extension 360 or 362 in alternative embodiments can be either stationary or moveable. Also, the extension 360 is substantially horizontal, while the extension 362 is at a predetermined angle. Another main difference is that a timing device 366, preferably an electronic timing device, is coupled to and protrudes from an outside surface 368 of the first section 312. The timing device 366 comprises an extension 370 that extends to a first position, e.g., a contacting position, and retracts to a second position, e.g., a non-contacting position. The timing device 366 is configured to automatically extend the extension 370 when a user selected predetermined time duration has expired and retract the extension 370 either automatically or through manual manipulation after the first section 312 is in the first position, e.g., closed.

In operation, a user will set a predetermined duration of time on the timing device 366 after moving the first section 412 from the first position, e.g., closed, to the second position, e.g., opened a predetermined amount. Once the selected predetermined duration of time has elapsed, the timing device 366 is configured to automatically extend the extension 370 until contact is made with the extension 362. The force caused by the contact is enough to initiate movement of the first section 312 to return the first section 312 to the first position. By having the extension 362 extending at a predetermined angle less force is needed to return the first section 312 to the first position. The other functions as described above for embodiments one and two also are performed by the apparatus 300 in embodiments three and four.

Figure 6:
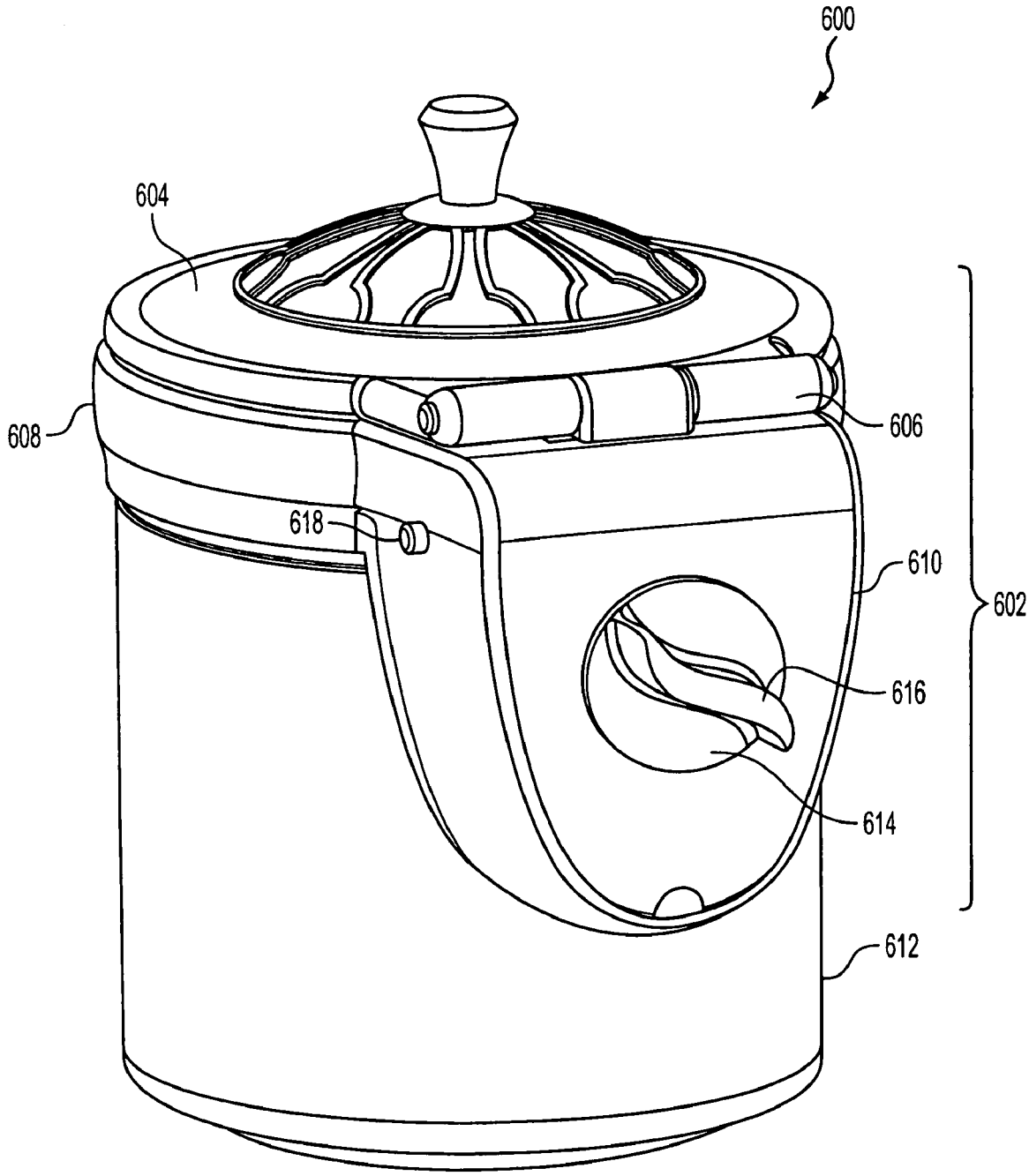
FIG. 6 is a perspective view of a safety device for candles according to a third embodiment of the present invention.

FIG. 6 is a perspective view of a system 600 according to a third embodiment of the present invention. System 600 includes an apparatus 602. Apparatus 602 includes a closing portion 604 hingedly coupled via coupling device 606 to an attachment portion 608 and a system 610. Attachment portion 608 is releaseably secured, via any one of the securing systems discussed above or otherwise known in the art, to container 612. System 610 can be used to automatically extinguish a candle, and can include a support rod 618 and a timing device 614 having a gripping device 616. Further details of system 610 according to an embodiment of the present invention are described below with reference to FIGS. 7–8. It is to be appreciated, other configurations can be used for system 610.

Figure 7:
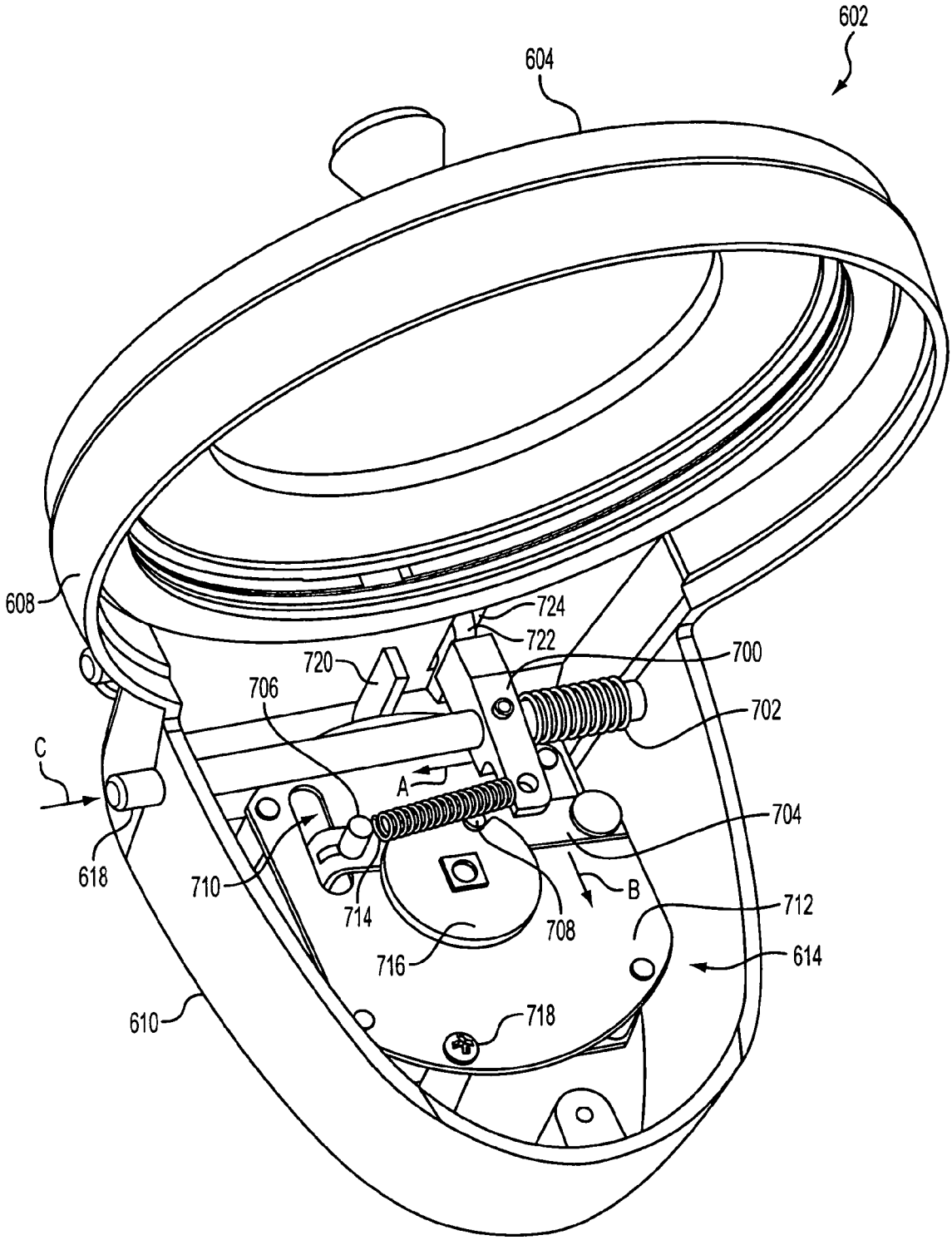
FIG. 7 shows a section of the safety device for candles of FIG. 6 when a closing device is in a closed position.
Figure 8:
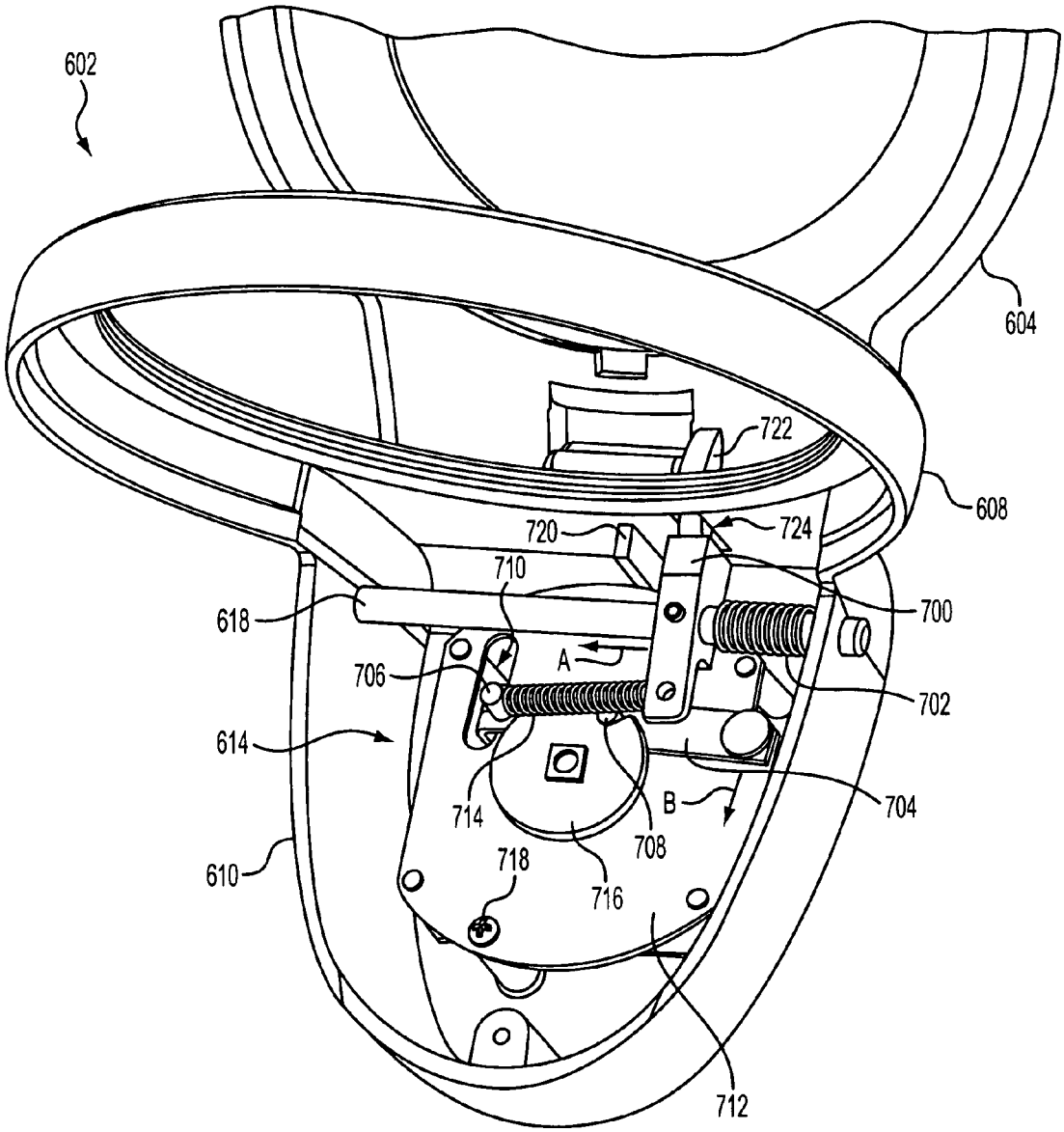
FIG. 8 shows a section of the safety device for candles of FIG. 6 when a closing device is in an open position.

FIG. 7 shows apparatus 602 with a section removed so that details of apparatus 602 when closing portion 604 is in a closed state can be seen. FIG. 8 shows system 610 with a section removed so that details of apparatus 602 when closing portion 604 is in an open position can be seen.

In an embodiment, system 610 can further include a support device 700 and a resilient device 702 coupled to support rod 618. The coupling can be based on support rod 618 passing through an opening in support device 700 and an open area of resilient device 702. It is to be appreciated that other coupling methods and/or devices can also be used. Although coupled, support device 700 and/or resilient device 702 may slide along support rod 618.

In an embodiment, timing device 614 can further include an arm 704 having extensions 706 and 708. Arm 704 passes through an opening 710 in a body 712. A resilient device 714 is coupled between extension 706 and support device 700. A rotating device 716 interacts with extension 708 to move arm 704 in a direction of arrow B when an OFF state of timing device 614 is reached, as described in detail below. Timing device 614 can be secured to apparatus 602 using any known securing devices, such as a screw 718, bolts, adhesive material, or the like. Both resilient devices 702 and 714 are biased to push or pull, respectively, support rod 618 and support device 700 in a direction of arrow A. In the perspective of FIGS. 7 and 8, this is the leftward direction. A stopping device 720 can be used to limit movement of supporting rod 618 and support device 700.

In an embodiment, closing portion 604 includes an extension 722 that extends through an opening 724 in attachment device 608. Extension 722 interacts with support device 700, as will be described in detail below.

When a user wishes to light a candle (not shown) in container 612, timing device 614 should be turned ON. After turning ON timing device 614, support rod 618 is pushed by the user to move support rod 618 and support device 700 in a direction of arrow C. In the perspective of FIGS. 7 and 8, this direction is rightward. Then, closing portion 604 is opened so that extension 722 can be supported by support device 700. This support can be enhanced based on friction between extension 722 and support device 700. Once extension 722 is supported by support device 700, several types of events can automatically cause resilient device 714 and/or resilient device 702 to pull or push, respectively, support rod 618 and support device 700 in the direction of arrow A, which causes automatic extinguishing of the candle, as will be described in more detail below.

In one embodiment, an event can be when timing device 614 reaches an OFF state. This moves arm 704 in the direction of arrow B causing resilient device 714 to pull support rod 618 and support device 700 in the direction of arrow A. When support device 700 moves in the direction of arrow A, extension 722 becomes unsupported by support device 700. This causes closing portion 604 to move to a closed state, which extinguishes the candle.

In another embodiment, an event can be when any aspect of system 600 is disturbed, as described above. The disturbance causes resilient device 702 to move support rod 618 and support device 700 in the direction of arrow A. Resilient device 714 may also assist resilient device 702 in the movement of support rod 618 and support device 700. Again, when support device 700 moves in the direction of arrow A extension 722 is unsupported by support device 700. This causes closing portion 604 to move to a closed state, which extinguishes the candle.

CONCLUSION

While various embodiments of the present invention have been described above, it should be understood that they have been presented by way of example only, and not limitation. It will be apparent to persons skilled in the relevant art that various changes in form and detail can be made therein without departing from the spirit and scope of the invention. Thus, the breadth and scope of the present invention should not be limited by any of the above-described exemplary embodiments, but should be defined only in accordance with the following claims and their equivalents.

What is claimed is:

1. An apparatus, comprising:

a cover that moves between an open and closed position to cover or uncover an opening of a container used to hold a candle;

an automatic extinguishing system having an automatic extinguishing device held in a housing, the automatic extinguishing device extinguishing the candle, when the candle is burning, through control of the movement of the cover; and a container-opening-shaped support connected directly to the housing and hingedly supporting the cover on a peripheral portion of the support, wherein the container-opening-shaped support is removeably positioned on and completely outside of the opening of the container and away from the candle, wherein the automatic extinguishing device comprises, a first support device that holds the cover open in a first position;

a rest block that holds the first support device in the first position;

a timing device having an arm and a first resilient device coupled between the arm and the rest block, the first resilient device being biased in a first direction;

a second resilient device coupled between a housing of the automatic extinguishing means and the rest block, the second resilient device being biased in a second direction; and a rod passing through an opening in the housing, through an opening in the rest block, and through the second resilient device, the rod being coupled to the rest block.

2. The apparatus of claim 1, wherein during an ON state of the automatic extinguishing device the first support device is supported in the first position by the rest block to keep the cover open.

3. The apparatus of claim 1, wherein an OFF state of the automatic extinguishing device is initiated by at least one of:

the timing device moving the rest block in the first direction, such that the first support device is unsupported and in a second position, which causes the cover to close;

the rod moving the rest block in the second direction, such that the first support device is unsupported and in the second position, which causes the cover to close.

4. The apparatus of claim 1, wherein the first support device is only able to move from to the first position when the timing device is started.

* * * * *